United States Patent [19]

Kikukawa

[11] Patent Number: 4,734,298

[45] Date of Patent: Mar. 29, 1988

[54] METHOD OF PROVIDING MARKS ON SURFACE-TYPE FASTENERS

[75] Inventor: Norio Kikukawa, Namerikawa, Japan

[73] Assignee: Yoshida Kogyo K.K., Tokyo, Japan

[21] Appl. No.: 885,025

[22] Filed: Jul. 14, 1986

[30] Foreign Application Priority Data

Jul. 18, 1985 [JP] Japan ..... 60-158859

[51] Int. Cl.[4] ..... D06P 5/00; B41F 17/00; B41M 1/12; B05D 5/00

[52] U.S. Cl. ..... 427/256; 8/445; 8/495; 101/35; 101/129; 427/294

[58] Field of Search ..... 101/35, 114, 126, 129, 101/470; 8/445, 495; 427/282, 256, 294

[56] References Cited

U.S. PATENT DOCUMENTS 3,221,648 12/1965 Weiss ..... 101/129
3,948,597 4/1976 Sakoaka ..... 8/445
4,172,702 10/1979 Bernier et al. ..... 427/27 X

FOREIGN PATENT DOCUMENTS 8191808 12/1983 Japan .
374195 6/1932 United Kingdom ..... 101/425

*Primary Examiner*—Michael R. Lusignan
*Attorney, Agent, or Firm*—Hill, Van Santen, Steadman & Simpson

[57] ABSTRACT

A viscous printing paste is imprinted on a reverse surface of a foundation fabric of a surface-type fastener, and then the paste while being viscous is drawn by a suction force to penetrate the foundation fabric from the reverse surface to an obverse surface from which a multiplicity of interlocking elements project. Upon setting of the printing paste, a distinctive mark is produced on the obverse surface of the foundation fabric. With the foregoing processing steps, a large mark can be provided on the surface-type fastener without effecting negative influence on the shape and function of the interlocking elements.

13 Claims, 8 Drawing Figures

METHOD OF PROVIDING MARKS ON SURFACE-TYPE FASTENERS

BACKGROUND OF THE INVENTION

1. Field of the Invention

The present invention relates generally to the manufacture of a surface-type fastener having a multiplicity of interlocking elements such as hooks or loops for use on a cover of a garment, a bag, a brief case or the like, and more particularly to a method of providing a mark or design pattern on such surface-type fastener.

2. Prior Art

According to a method disclosed in Japanese Utility Model Laid-open Publication No. 58-191808, marks are provided on a surface type fastener in such a manner that an elongate strip of thermoplastic synthetic resin is placed over loop-shaped interlocking elements disposed on one surface of a foundation fabric, then portions of the elongate strip are cut off and fused to the one surface of the foundation fabric by a high-frequency welder or a ultrasonic welder having seal-cut blades complementary in contour to the respective marks to be produced, and finally the remaining non-fused portion of the strip is removed.

With the marks thus provided, the fused strip portions or marks themselves cover portions of the interlocking elements, and hence the covered interlocking element portions are no longer effective to perform their prescribed interlocking function. Accordingly, the disclosed method is not suitable in an application wherein a mark or design to be provided has a relatively large surface area.

According to another known method, a mark is provided on the reverse surface of a foundation fabric. The mark thus provided is however invisible as the reverse surface is concealed when the fastener is attached to an article such as a garment. Accordingly, this method is practically useless.

SUMMARY OF THE INVENTION

It is therefore an object of the present invention to provide a method of providing a mark on the obverse side of a surface-type fastener without effecting negative influence on the shape and function of interlocking elements disposed on the obverse side.

Another object of the present invention is to provide a simple method of providing a distinctive mark or design on the obverse side of a surface-type fastener.

According to the invention, a viscous printing paste is imprinted on a reverse surface of a foundation fabric of a surface type fastener, and then the paste while being still viscous is drawn by a suction force to penetrate the foundation fabric from the reverse surface to an obverse surface on which a multiplicity of interlocking elements are disposed. Upon curing of the printing paste, a distinctive mark is produced on the obverse surface of the foundation fabric.

Many other advantages, features and other objects of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
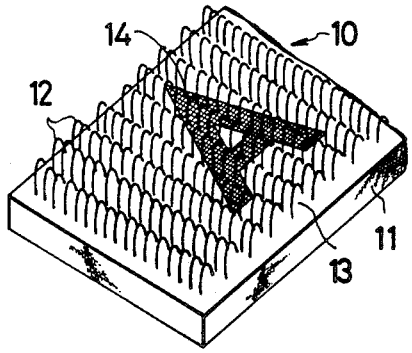
FIG. 1 is a fragmentary schematic perspective view of a hooked fastener tape having a mark provided thereon in accordance with the present invention.

FIG. 1 shows a fastener tape 10 including a foundation fabric 11, and a multiplicity of interlocking elements 12 disposed on and projecting from one surface 13 of the foundation fabric 11. The foundation fabric 11 is formed of natural or synthetic yarns, perferably polyamide yarns woven or knitted together. The interlocking elements comprise hooks 12 formed by severing loops of thermoplastic monofilament woven or knitted with yarns of the foundation fabric 11 as the latter is produced. The surface 13 is normally exposed to sight and it is hereinafter referred to as "obverse surface". The hooked fastener tape 10 has a mark 14 (letter "A" in the illustrated embodiment) provided on the obverse surface 13 according to the present invention.

Figure 2:
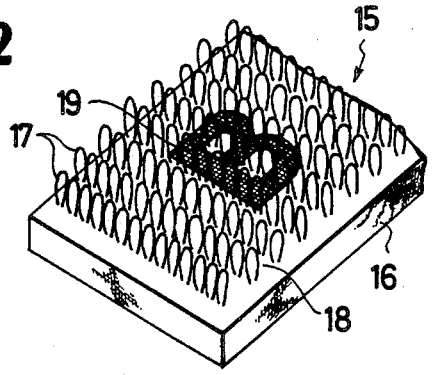
FIG. 2 is a view similar to FIG. 1, showing a looped fastener tape having a mark provided thereon in accordance with the invention.
Figure 3:
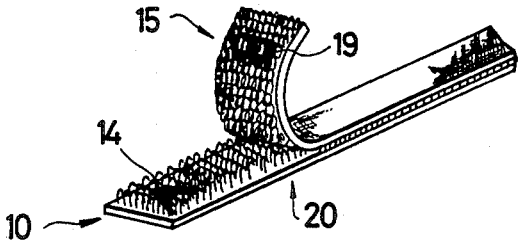
FIG. 3 is a schematic perspective view, on reduced scale, of a loop-and-hook fastener including the fastener tapes shown in FIGS. 1 and 2.

A fastener tape 15 shown in FIG. 2 comprises a foundation fabric 16 woven or knitted of natural or synthetic yarns, preferably polyamide yarns, and a multiplicity of loop-shaped interlocking elements 17 disposed on and projecting from an obverse surface 18 of the foundation fabric 16. The foundation fabric 16 has a mark 19 (letter "B" in the illustrated embodiment) provided according to the invention. In use, the looped fastener tape 15 is combined with the hooked fastener tape 10 to jointly constitute a surface-type fastener 20 generally known as a loop-and-hook fastener, as shown in FIG. 3.

Figure 4A:
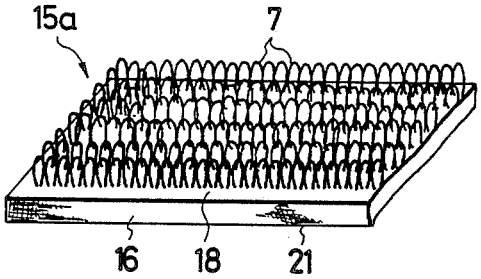
FIGS. 4A through 4D are schematic perspective views showing the manner in which a mark is provided on a surface-type fastener.

The marks 14, 19 are provided on the respective fastener tapes 10, 15 in such a manner as shown in FIGS. 4A–4D. A fastener tape **15*a* to be processed is shown in FIG. 4A. This fastener tape 15*a* includes a multiplicity of loops 7 on an obverse surface 18 of a foundation fabric 16 which is formed of polyamide yarns. The foundation fabric 18** has not been dyed and has a white color.

Figure 4B:
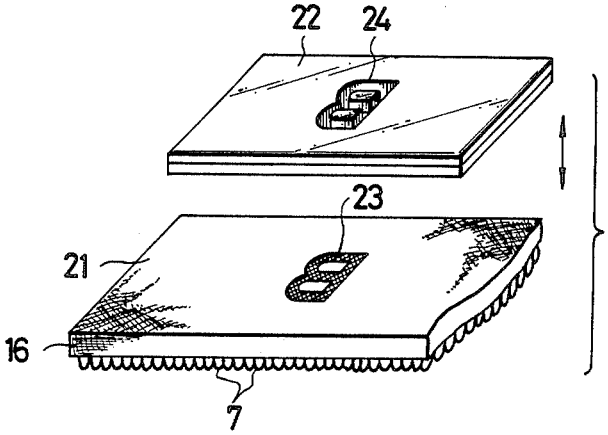

Then with the aid of a printing plate 22, a viscous printing paste 23 is imprinted on the reverse surface 21 of the foundation fabric 16, as shown in FIG. 4B. The printing plate 22 has an aperture 24 which is reversed in contour to a mark to be provided on the obverse surface 18, so that imprinted printing paste 23 produces a mark having a reversed image of the desired mark. The printing paste contains a coloring material, such as a dye, a pigment or a color developer, a suitable agent or a combination thereof. Although not shown, a printing screen plate may be employed in place of the printing plate 22.

Figure 4C:
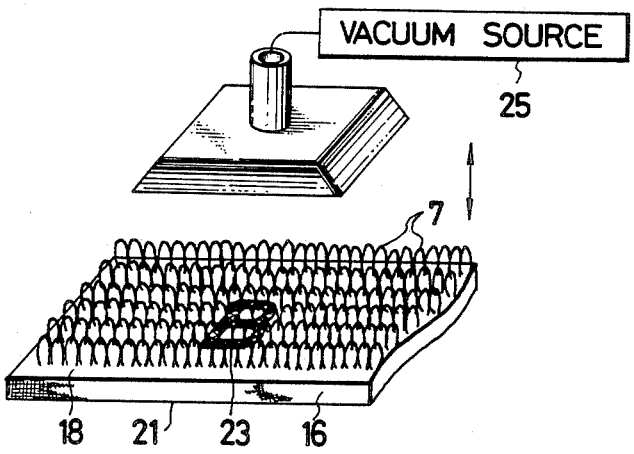

Thereafter, as shown in FIG. 4C, the imprinted printing paste 23 while being still viscous is drawn by a suction force produced by a suitable vacuum source 25 such as a vacuum pump, so as to strike through or penetrate the foundation fabric 16 from the reverse surface 21 to the obverse surface 18. Thus, a mark of the printing paste 23 appears on the obverse surface, the mark having a reversed image of the mark on the reverse surface 21.

Figure 4D:
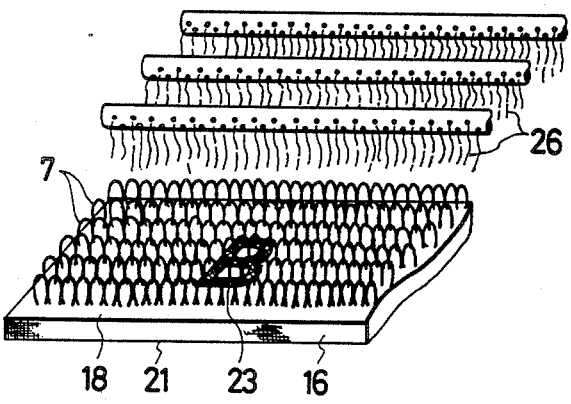

Finally, the printing paste 23 is, as shown in FIG. 4D, cured by being heated with saturated vapor, overheated vapor or hot air 26, thereby setting the configuration of the mark 19 on the obverse surface 18 of the foundation fabric 16. The mark 19 thus provided is distinctive and constitutes an accurate mirror image of the initially imprinted mark on the reverse surface 21.

As an optional processing step, a foundation fabric 16 is dyed either before or after the curing of the printing paste 23 in which case a suitable agent is used in combination with the coloring material, as described below.

Figure 5:
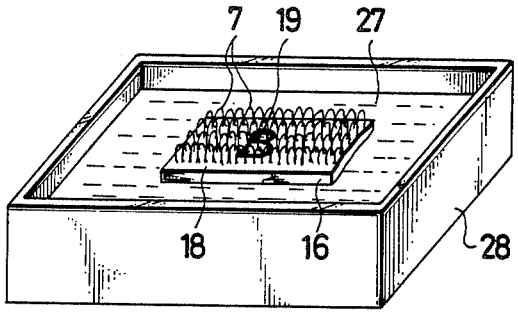
FIG. 5 is a schematic view showing a modification of the present invention.

After having been printed with the mark 19 thereon, the white foundation fabric 16 is dyed by being immersed in a dye liquid 27 contained in a bath or container 28, as shown in FIG. 5. In this instance, the printing paste 23 contains a resist printing agent, then a distinctive white mark is left in a background color on an obverse surface of the dyed foundation fabric. More specifically, the foundation fabric 16 is formed of polyamide yarns containing amino groups, and the dye liquid 27 is acidic and contains anionic dyes capable of being linked by ion-bonding to the amino groups of the polyamide yarns. The resist printing agent is resistant to dyeing and capable of linking by ion-bonding to the amino groups of the polyamide yarns before the foundation fabric 16 is dyed. As an alternative, the dye liquid 27 may contain both an acidic dye and a basic dye and the resist printing agent of the printing paste 23 may be resistant to the acidic dye but reactive to the basic dye. In this case, a colored mark is provided in a background color on the obverse surface of the dyed foundation fabric.

It is possible to increase the color concentration of the marked portion of a dyed foundation fabric by printing the foundation fabric with a printing paste containing a color concentrating agent. The foundation fabric is formed of polyamide yarns containing amino groups and a dye liquid used for dyeing the foundation fabric contains an acidic dye capable of linking by ion-bonding to the amino groups of the foundation fabric. The color concentrating agent contains amino groups larger in number than the amino groups of the foundation fabric, and a chemical component capable of linking to the amino groups of the polyamide yarns. During the dyeing process, the acidic dye is linked with the amino groups of the color concentrating agent, thereby increasing the color concentration of the marked portion of the foundation fabric.

Alternatively, before heating the printed paste 23, the white foundation fabric 16 may be dyed by being immersed in a dye liquid. In this instance, the printing paste 23 contains a discharging agent capable of discharging or removing the dye in the dye liquid so that a distinctive white mark is left in a background color on an obverse surface of the dyed foundation fabric. If the printing paste also contains a dye not affected by the discharging agent, a colored mark will be produced in a background color on the obverse surface of the dyed foundation fabric. As a further alternative, it is possible to imprint a printing paste containing a discharging agent on a previously dyed foundation fabric. Upon setting of the imprinted paste, the dye is removed by the discharging agent from the foundation fabric, thereby leaving a distinct white mark in a background color on the dyed foundation fabric. In case the printing paste also contains a dye resistant to the discharging agent and capable of generating a color which is different from the color of the foundation fabric, a colored mark is produced on the colored foundation fabric.

As described above, since the printing paste is first imprinted on the reverse surface of the foundation fabric which is free of the interlocking elements, and then forced to penetrate the foundation fabric, a distinctive mark is provided on the obverse surface of the foundation fabric without effecting negative influence on the shape and function of the inter-locking elements. Accordingly, the present method is particularly suitable for the production of a surface-type fastener having a mark occupying a relatively large surface area of the foundation fabric.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of providing a mark on an obverse side of a surface-type fastener including a multiplicity of interlocking elements on one of opposite surfaces of a foundation fabric, said method comprising the steps of:

(a) imprinting a viscous printing paste on the other surface of the foundation fabric which is free of the interlocking elements, to produce a first printed mark thereon, the first printed mark thus produced having a reversed image of a mark to be ultimately provided;

(b) forcing the imprinted printing paste while being still viscous to penetrate the foundation fabric from the element-free other surface to the one surface on which the interlocking elements are disposed, thereby producing a second printed mark on the element-carrying one surface of the foundation fabric; and (c) heating the printing paste to cure the same, thereby setting the configuration of the second mark.

2. A method according to claim 1, said forcing step (b) comprising drawing the imprinted paste by a suction force.

3. A method according to claim 1, said printing paste containing one of a coloring material, an agent or a combination thereof.

4. A method according to claim 1, after said heating step (c), further comprising the step of dyeing the foundation fabric by immersing the same in a dye liquid, the printing paste containing a resist printing agent resistant to dyeing.

5. A method according to claim 4, the foundation fabric being formed of polyamide yarns containing amino groups, the dye liquid being acidic and containing anionic dyes capable of being linked by ion-bonding to the amino groups of the polyamide yarns, the resist printing agent being capable of linking by ion-bonding to the amino groups of the polyamide yarns.

6. A method according to claim 4, the dye liquid containing both an acidic dye and a basic dye, the resist printing agent being resistant to one of the acidic and basic dyes and reactive to the other dye.

7. A method according to claim 6, the foundation fabric being formed of polyamide yarns containing amino groups, the acidic dye being capable of linking by ion-bonding to the amino groups of the polyamide yarns, the resist printing agent being reactive to the basic dye.

8. A method according to claim 1, after said heating step (c), further comprising the step of dyeing the foundation fabric by immersing the same in a dye liquid, the printing paste containing a color concentrating agent reactive to the dye liquid to increase the color concentration of the second mark.

9. A method according to claim 8, the foundation fabric being formed of polyamide yarns containing amino groups, the color concentrating agent containing amino groups larger in number than the amino groups of the polyamide yarns and also containing a chemical component capable of linking to the amino groups of the polyamide yarns, the dye liquid containing an acidic dye capable of linking by ion-bonding to the amino groups of both the color concentrating agent and the polyamide yarns.

10. A method according to claim 1, between said forcing and heating steps (b) and (c), further comprising the step of dyeing the foundation fabric by immersing the foundation fabric in a dye liquid, the printing paste containing a discharging agent capable of discharging the dye in the dye liquid.

11. A method according to claim 10, the printing paste further containing a dye resistant to the discharging agent.

12. A method according to claim 1, the foundation fabric having been dyed, the printing paste containing a discharging agent capable of removing the dyes from the previously dyed foundation fabric.

13. A method according to claim 12, the printing paste further containing a dye resistant to the discharging agent and capable of generating a color which is different from the color of the previously dyed foundation fabric.

* * * * *